US005139613A

United States Patent [19]

Lachapelle

[11] Patent Number: 5,139,613

[45] Date of Patent: Aug. 18, 1992

[54] PROCESS FOR PREPARING A PAPER PULP USING CARBON DIOXIDE AS AN ACIDIFYING AGENT FOR A BLEACHED PULP

[75] Inventor: Raymond C. Lachapelle, Kirkland, Canada

[73] Assignee: Canadian Liquid Air Limited, Quebec, Canada

[21] Appl. No.: 146,587

[22] Filed: Jan. 21, 1988

[51] Int. Cl.[5] ..... D21C 9/14; D21C 9/16

[52] U.S. Cl. ..... 162/60; 162/63; 162/78; 162/87; 162/88

[58] Field of Search ..... 162/89, 60, 78, 88, 162/76, 87, 63

[56] References Cited

U.S. PATENT DOCUMENTS 3,806,404 4/1974 Liebergott et al. ..... 162/65
4,042,452 8/1977 Arhippainen et al. ..... 162/89
4,568,420 4/1986 Nonni et al. ..... 162/65
4,617,090 12/1984 Chum et al. ..... 162/76

OTHER PUBLICATIONS

Singh et al. "The Bleaching of Pulp"; Tappi Press Atlanta, Ga., 1979 p. 213-214; 387-379; 382-390.

*Primary Examiner*—Steve Alvo
*Attorney, Agent, or Firm*—Curtis, Morris & Safford

[57] ABSTRACT

A process for souring chemical or mechanical cellulosic pulp using carbon dioxide to obtain proper acidification of the pulp slurry. The souring is performed after a single or a multistage bleaching sequence ending with sodium hypochlorite, calcium hypochlorite or hydrogen peroxide or the like in a common process for the preparation of paper pulp. The use of $CO_2$ permits bleaching to continue because $CO_2$ does not destroy the bleaching residuals remaining from the single or last bleaching stages.

8 Claims, No Drawings

PROCESS FOR PREPARING A PAPER PULP USING CARBON DIOXIDE AS AN ACIDIFYING AGENT FOR A BLEACHED PULP

TITLE OF THE INVENTION

Pulp souring process enhancing conservation of specific bleaching agent residuals.

FIELD OF THE INVENTION

The present invention relates to the use of a pulp souring agent after a single or a multistage bleaching sequence ending with sodium hypochlorite or calcium hypochlorite (designated as an H stage) or hydrogen peroxide (designated as a P stage) or the like.

BACKGROUND OF THE INVENTION

In the pulp and paper industry, various processes are employed for bleaching pulps. Bleaching is a continuation of the cooking process in which the ligneous material and coloring matter remaining in the chemical pulp are removed selectively with as little degradation of the pulp fibers as possible. Bleaching of pulp has advanced to a high degree of sophistication involving single stage and multi-stage procedures. The choice of bleaching agent has traditionally been dependent on whether the pulp is a mechanical pulp or a chemical pulp.

Mechanical and groundwood pulps have many desirable characteristics for low-cost papers, e.g. high yield, good bulk, high opacity, and good printing properties. The natural brightness of these pulps is, however, too low for the better grades of groundwood content papers. Also, the brightness of unbleached groundwood pulp varies with the species, the wood process, its age and its quality. Hence, the need for suitable bleaching processes arose in order to compensate for natural brightness variations of the wood; to obtain still brighter pulp to meet the ever-increasing demands for higher quality groundwood papers; and to improve the brightness of the pulp. The most important characteristic of mechanical pulp is the low cost of manufacture and this is due to its high unbleached yield. Oxidizing agents, for example, hydrogen peroxide (P) and hypochlorites (H) and reducing agents, for example, hydrosulfites (Hs), borohydrides (B), amino-boranes, peracetic acid, and bisulfites have been used since they raise the brightness of mechanical pulps without materially effecting the yield. Bleaching efficiency can sometimes be improved when combining these chemicals in multistage systems, e.g. two stages P-Hs or Hs-P or three stage Hs-P-Hs systems.

The bleaching of chemical pulp is accomplished in several stages. A "stage" constitutes a phase starting with addition and reaction of a chemical with a pulp, and ending with the washing of the pulp. Within each stage there are many process variables which are dictated by the type of reaction desired in that particular stage, and the operating conditions of the stage. These variables include: percent of chemical added and consumed, chemical concentration, consistency, temperature, time and pH. A series of such stages is called a bleaching sequence.

In such multistage bleaching processes, the first operation for the removal of lignin and other encrustants (usually following the digestion stage and the subsequent washing stage in a kraft, soda or sulfite process) consists in treating the pulp aqueous suspension with elemental chlorine in aqueous solution. A bleaching stage performed using elemental chlorine is designated as a C stage. Chlorination of the unbleached pulp so changes the ligneous impurities that they become in part soluble in water while, of the portions not readily soluble in water, a part is soluble in alkaline solutions such as dilute sodium hydroxide.

Among the agents used to bleach chemical pulp are elemental chlorine, chlorine dioxide, hypochlorites, chlorites, peroxides, chlorates, bichromates, and permanganates, as well as reducing agents, e.g. sulfurous acid, bisulfites, dithionites, and borohydrides. However, for chemical pulps (e.g. those made by the kraft, sulfite or soda processes) the bleaching agents traditionally used are chlorine and chlorine dioxide (a bleaching stage performed using chlorine dioxide is designated as a D stage) usually used in a multistage process. The first step thus usually consists of treating the pulp in an aqueous suspension with chlorine in solution in the aqueous phase. Chlorine dioxide may be used either in admixture with the chlorine, or in replacement of the chlorine, in this first stage. In some mills, hydrogen peroxide is used as a final bleaching treatment in a high density storage chest.

The next stages usually consist of a washing stage, preferably an alkaline washing or extraction stage (designated as an E stage). The products of pulp chlorination and of the oxidative bleaching stages are more soluble in an alkaline medium than in water, and they are generally taken out of the system by an alkaline extraction. For the attainment of brightness with strength preservation, for brightness stability and bleaching economy, the reaction products resulting from chlorination and oxidative bleaching are removed as they are formed in those operations by means of alkaline extraction. Caustic soda is the preferred agent, but other alkalis have been used. Some examples of multistage bleaching sequences include CEH, CEDP, CEDEDP and CEHH.

After a single or a multistage bleaching, it is common practice to treat or "sour" the bleached pulp with sulfur dioxide. This $SO_2$ treatment serves many purposes.

For example, in the case of a multistage bleaching performed using sodium hypochlorite or calcium hypochlorite, hydrogen peroxide and chlorine dioxide among others, the $SO_2$ treatment destroys the active bleaching agents remaining from the hypochlorite, peroxide and chlorine dioxide stages. Also, the $SO_2$ treatment is required to bring the pulp solution to non-alkaline conditions in order to avoid undesirable losses with regard to brightness. It is well known that alkaline conditions tend to darken the pulp.

Presently, the pulp and paper industry universally employs $SO_2$ dissolved in water to perform acidification or neutralization in both chemical and mechanical pulp bleaching. However, the use of sulfur dioxide has the consequence of destroying all the active bleaching agent residues remaining from bleaching stages. In the case of a bleaching stage performed with chlorine dioxide, it is desirable to treat the bleaching waters with $SO_2$ to destroy the remaining bleaching agents.

However, when it comes to bleaching agents such as sodium or calcium hypochlorite and hydrogen peroxide, their destruction is by no means necessary because these compounds present low toxicities and do not interfere with subsequent paper making operations. As a matter of fact, the presence of such residuals would be extremely desirable because it would allow the bleaching process of the pulp to slowly continue during subsequent pulp and paper making operations. This prolongation of the bleaching process would likely yield a final product possessing enhanced brightness properties without increasing operational costs. It is also to be noted that these bleaching agents and their residuals also possess mild biocide properties that allow for the prevention of bacterial growth in the pulp solution. The proliferation of bacteria in the pulp solution usually leads to undesirable darkening of the pulp itself.

Furthermore, the use of aqueous $SO_2$ solutions may present serious health risks for the workers handling the treated pulp as well as potential environmental hazards that could be caused by the disposal of corrosive and polluted $SO_2$ solutions in natural effluents.

Therefore, a souring agent possessing the property to diminish alkaline conditions while maintaining desirable bleaching agent residuals in the pulp solution would be highly desirable.

SUMMARY OF THE INVENTION

Thus, in a process for the preparation of paper pulp comprising a single or multistage bleaching of the pulp comprising at least one single or last peroxide bleaching stage or treatment followed by treatment of the bleached pulp with aqueous sulfur dioxide, the present invention consists of substituting carbonic acid for sulfur dioxide. Carbonic acid may be introduced in the form of $CO_2$ gas and/or $CO_2$ liquid in the dilution and/or washing waters.

The process of the present invention may be used on either chemical, mechanical or recycled pulp, regardless of the bleaching process. In other words, the process of the present invention may be used after a multistage or a single stage bleaching process provided that the last or single step is performed using sodium hypochlorite or calcium hypochlorite or hydrogen peroxide or equivalents thereof.

The process of the present-invention is also suitable for thermomechanical and chemical thermomechanical pulps which usually require a single stage bleaching.

Numerous interesting advantages result from the use of the process of the present invention. Thus, both the use of carbon dioxide and sulfur dioxide eliminate pulp darkening alkaline conditions by acidifying the resulting pulp slurry. However, while the reducing action of sulfur dioxide destroys all the bleaching agent residuals present in the pulp solution, carbon dioxide will not destroy residuals from bleaching agent such as sodium hypochlorite and calcium hypochlorite and hydrogen peroxide. Thus, the fact that these residuals can be maintained in the pulp solution will lead to a continuation of the bleaching process without necessitating further stages or further addition of bleaching agents, thereby increasing the brightness of the resulting pulp while maintaining the viscosity of the pulp solution at the same level. Furthermore, the quality of the resulting pulp product will be enhanced thus leading to a more valuable product.

Therefore, the replacement of $SO_2$ by $CO_2$ will lead to much more efficient bleaching stages without increasing operational costs and operational times. Furthermore, the cost of carbon dioxide can be as much as 2 to 10 times lower than the cost of sulfur dioxide, making $CO_2$ a very economical souring and pulp and paper treating agent.

Another important advantage of the process of the present invention may be found at the environmental level. At the present time, the quantities of residual sulfur dioxide souring solution dumped in various effluents are extremely important and present serious threats as far as ecological equilibrium of the neighbouring ecosystems is concerned. On the other hand, the use of $CO_2$ does not present such risks because $CO_2$ is far less soluble in water and exhibits no toxicity at the levels employed. Furthermore, $CO_2$ is odorless whereas $SO_2$ has a strong, unpleasant odor.

Finally, it is to be noted that because carbon dioxide does not destroy desirable bleaching agent residuals, these residuals will not only continue their bleaching action but will also act as mild biocides and prevent proliferation of undesirable bacteria possessing the ability to darken the pulp.

The novel process of the present invention is carried out in the following manner. The pulp is first bleached using single or multistage bleaching processes known in the art. After the last or single bleaching step of the pulp, carbon dioxide is introduced either in the pulp slurry, the dilution waters or the washing waters as carbonic acid either in gaseous, liquid or solution form. The quantity of $CO_2$ to be added will vary but because the solubility of $CO_2$ in water is rather low, $CO_2$ will usually be added until the pulp solution reaches a saturated stage.

It is also possible to oversaturate the pulp slurry by either injecting $CO_2$ at a precise location or by performing several sequential additions to the pulp solution. In any event, the amount of $CO_2$ to be added to the pulp solution is not important in the sense that one will add $CO_2$ until the desired degree of alkalinity is reached. Therefore, the amount of $CO_2$ injections required will depend on the type of bleaching stage performed as well as on the targetted final degree of alkalinity. In standard procedures, alkalinity is measured by a pH-meter and $CO_2$ addition is automatically stopped when the solution has been stabilized at the desired alkalinity. Hence, the $CO_2$ treatment will allow the pH of the pulp solution to be stabilized between 4.0 and 7.5. It is to be noted that there is virtually no upper limit as to the starting pH of the bleached pulp solution before the $CO_2$ treatment is effected. In other words, it is possible for example to use the process of the present invention to bring the pH of a pulp solution from 13.5 to 4. Therefore, the pH of the pulp solution before treatment may be 13.5 or less.

The temperature at which the $CO_2$ treatment or souring of the pulp will be performed may vary widely but will usually range between 5° and 80° C. As for the time required to effect the $CO_2$ treatment or souring of the pulp, it varies between 30 seconds and 120 minutes. It is also desirable to have a pulp consistency ranging between 0.1 and 25%.

The process of the present invention will be further illustrated by referring to the following examples which are introduced in order to illustrate rather than limit the scope of the claims.

EXAMPLE 1

A thermomechanical pulp slurry was bleached following a PRP (Peroxide, reducing agent and peroxide) sequence. After the second P (Peroxide) stage, the pulp P-1 had a brightness of 70.65 ISO. The pulp slurry was then treated with a hydrogen peroxide solution containing 2% $H_2O_2$ with respect to the pulp, 1.5% NaOH, 1% $Na_2SiO_3$ and 0.05% $MgSO_4$. The pulp consistency was 10%, the reaction temperature 65° C. and the retention time 2 hours. The pH of the resulting pulp solution was 8.3 and the residual hydrogen peroxide concentration was 1.3% with respect to the dry pulp. The pulp slurry was then concentrated to a consistency of 27% and divided into two samples. $SO_2$ water was added to the first sample in order to adjust the pH to 5.5 and to bring the consistency back to 10%. No hydrogen peroxide residue was found in this first sample. After sheet making, the brightness was measured and determined to be 80.05% ISO. The second sample was treated with water containing dissolved carbon dioxide. The pulp was also diluted to a consistency of 10% and its pH was adjusted to 5.7. The hydrogen peroxide residual concentration was found to be identical to the concentration measured before the souring treatment. Furthermore, the brightness of the resulting sheet was measured and found to be 81.17% ISO.

EXAMPLE 2

An unbleached thermomechanical pulp slurry having a brightness of 57.43% ISO was bleached using a peroxide bleaching stage. The peroxide solution contained the following compounds: 2% $H_2O_2$, 2% NaOH, 2% $Na_2SiO_3$, 0.5% $MgSO_4$ and 0.2% DTPA (Sodium diethylene triamine pentaacetate). The pulp consistency was 10%, the temperature was 85° C. and the retention time 30 minutes. The pH of the final pulp solution was found to be 8.1 and the peroxide residual concentration was equivalent to 0.61% $H_2O_2$ with regard to the dry pulp. The bleached pulp solution was then divided into two samples. To the first sample, $SO_2$ water was added to adjust the pH to 5.4. No peroxide residual could be found after the $SO_2$ injection. The pulp slurry was then drained and brightness sheets were made according to standard procedures. The brightness was then measured and determined to be 72.14% ISO. To the second pulp sample, dissolved $CO_2$ was injected into the pulp slurry until the pH reached 5.6. The peroxide residual concentration was then determined to be 0.58%. The pulp slurry was drained and brightness sheets were again made according to standard procedures. The brightness of the sheets was determined to be 74.24% ISO.

EXAMPLE 3

A chemical softwood kraft pulp slurry was bleached by following a $C_DE_ODP$ sequence. After the P stage, the pH was found to be 9.9 and the pulp solution was divided into two samples. One sample was treated with water $SO_2$ in order to adjust the pH to 6.0. The pulp slurry was then drained and brightness sheets were prepared following standard procedures. The brightness was determined to be 86.50% ISO. These brightness sheets were then heated for one hour at 105° C. The brightness was measured again and found to be 83.24% ISO. The second sample of the pulp solution was treated with an aqueous $CO_2$ solution in order to adjust the pH to 6.3. The pulp slurry was then drained and brightness sheets were made according to standard procedures. The brightness was determined to be 87.16% ISO. Again, the brightness sheets were heated for one hour at 105° C. The brightness after heating was measured and determined to be 85.30% ISO.

I claim:

1. In a process for the preparation of paper pulp comprising a single or multistage bleaching of a pulp suspension slurry with a bleaching stage using a bleaching agent selected from the group consisting of calcium hypochlorite, sodium hypochlorite and hydrogen peroxide, the improvement which comprises in a single stage bleaching, that the single bleaching stage is followed by treatment of the bleached pulp suspension with a carbon dioxide solution as an acidifying agent, or in a multistage bleaching, that at least the last bleaching stage is followed by treatment of the bleached pulp suspension with a carbon dioxide solution as an acidifying agent; said treatment of said bleached pulp with carbon dioxide being continued until the pulp suspension has been stabilized at a desired alkalinity between a pH of 4.0 and a pH of 7.5.

2. Process according to claim 1, further comprising a washing step performed between the bleaching and carbon dioxide acidifying steps.

3. Process according to claim 1 or 2, wherein the carbon dioxide solution is formed by introducing gaseous or liquid $CO_2$ into the dilution and/or washing waters.

4. Process according to claim 1, wherein the carbon dioxide solution is formed by introducing gaseous or liquid $CO_2$ into the pulp suspension.

5. Process according to claim 1, wherein the carbon dioxide treatment is performed at a temperature ranging between 5° and 80° C.

6. Process according to claim 1, wherein the carbon dioxide treatment is performed over a period of time ranging between 30 seconds and 120 minutes.

7. Process according to claim 1, wherein the consistency of the pulp in the pulp suspension ranges between 0.1% and 25%.

8. Process according to claim 1, wherein the pH of the pulp suspension before the carbon dioxide treatment is 13.5 or less.

* * * * *

UNITED STATES PATENT AND TRADEMARK OFFICE

CERTIFICATE OF CORRECTION

PATENT NO. : 5,139,613

DATED : August 18, 1992

INVENTOR(S) : Raymond C. Lachapelle

It is certified that error appears in the above-identified patent and that said Letters Patent is hereby corrected as shown below:

Claim 1, line 3 (column 6, line 15), delete "slurry".

Signed and Sealed this

Twenty-fourth Day of August, 1993

Bruce Lehman

*Attest:*

BRUCE LEHMAN

*Attesting Officer*

*Commissioner of Patents and Trademarks*